US006028369A

United States Patent [19]

Hirose et al.

[11] Patent Number: 6,028,369

[45] Date of Patent: Feb. 22, 2000

[54] ENGINE-OPERATED GENERATOR

[75] Inventors: Tadafumi Hirose; Ryuji Tsuru; Katsumi Maruyama, all of Wako, Japan

[73] Assignee: Honda Giken Kogyo Kabushiki Kaisha, Tokyo, Japan

[21] Appl. No.: 09/121,434

[22] Filed: Jul. 23, 1998

[30] Foreign Application Priority Data

Jul. 24, 1997 [JP] Japan ..... 9-198670

[51] Int. Cl.[7] ..... F01P 1/02

[52] U.S. Cl. ..... 290/1 A; 123/41.01

[58] Field of Search ..... 290/1 A, 1 B, 290/2; 322/1; 123/2, 41.01, 41.11

[56] References Cited

U.S. PATENT DOCUMENTS

| | | | |
|---|---|---|---|
| 3,259,752 | 7/1966 | Honda | 290/1 |
| 4,595,841 | 6/1986 | Yaguchi | 290/1 A |
| 4,608,946 | 9/1986 | Tanaka | 123/2 |
| 4,629,031 | 12/1986 | Kato et al. | 181/204 |
| 4,647,835 | 3/1987 | Fujikawa et al. | 322/1 |
| 4,702,201 | 10/1987 | Odo et al. | 123/2 |
| 4,835,405 | 5/1989 | Clancey et al. | 290/1 A |
| 4,859,886 | 8/1989 | Tanaka | 310/51 |
| 5,121,715 | 6/1992 | Nogami et al. | 123/41.7 |
| 5,433,175 | 7/1995 | Hughes et al. | 123/2 |
| 5,694,889 | 12/1997 | Ball et al. | 123/41.7 |
| 5,890,460 | 4/1999 | Ball et al. | 123/41.7 |

FOREIGN PATENT DOCUMENTS 64-3777 2/1989 Japan .

*Primary Examiner*—Nicholas Ponomarenko
*Attorney, Agent, or Firm*—Carrier, Blackman & Associates, P.C.; Joseph P. Carrier; William D. Blackman

[57] ABSTRACT

A compact engine-operated generator unit in which only one centrifugal fan for cooling is provided to restrain generation and leakage of operation noise, while an engine and a generator are still cooled efficiently. Particularly, the engine-operated generator unit comprises an engine and a generator driven by the engine arranged in a direction of a rotary shaft, and soundproof case housing the engine, the generator and other components therein, the generator includes an outer-rotor; a centrifugal fan provided on an end surface the outer-rotor of the generator remote from the engine; a duct covering the centrifugal fan, the generator and the engine and having a suction opening at a side facing the centrifugal fan; a discharge operating on a downstream side of the duct facing an exterior of the soundproof case; and a circulation space provided between the generator and the engine for introducing a part of cooling air flowing toward the engine into the generator to circulate again back to the centrifugal fan.

16 Claims, 10 Drawing Sheets

ENGINE-OPERATED GENERATOR

BACKGROUND OF THE INVENTION

1. Field of the Invention

The present invention relates to an engine-operated generator unit covered by a soundproof case in its entirety.

2. Discussion of Related Art

The engine-operated generator in which an engine and a generator driven by the engine are integrated as a portable unit is used at a construction work site generally. And in consideration of influences to the surroundings when it is operated in a city area especially at night, an engine-operated generator covered by a soundproof case in its entirety has been used widely in order to restrain operation noise to as low a level as possible.

In this kind of engine-operated generator unit, openings for inhaling or discharging air are made few in number and small in size to achieve necessary low noise level during operation. But on the one hand, it is necessary to devote great care to cooling the interior of the soundproof case because the area of the openings is small.

Japanese Utility Model Publication No. 64–3777 discloses an engine-operated generator in which an engine and a muffler are covered by a duct to be isolated from other instruments and cooling air is forcibly passed through the duct and discharged at the side of the muffler out of the soundproof case so that the high temperature properly discharged and cooling air is prevented from recirculating into the soundproof case.

However, as for a generator placed outside of the duct in the soundproof case, it is necessary to provide another cooling air passage besides the above duct or an exclusive cooling fan for the generator, and therefore the engine-operated generator is caused to be large-sized.

In the engine-operated generator of the Japanese Utility Model Publication No. 64–3777, a fan for cooling the generator is provided separately from a cooling fan for forcibly ventilating the duct covering the engine and the muffler, and air discharged from the fan for cooling the generator is joined in the duct after cooling the generator. Therefore, passages of air are complicated, there are two fan noise sources, and the apparatus is caused to be large-sized owing to installing two fans.

SUMMARY OF THE INVENTION

The present invention has been accomplished in view of the foregoing and one object of the invention is to provide a compact engine-operated generator unit in which only one centrifugal fan is provided to confine the fan noise source to one spot for thereby facilitating any desired countermeasure to noise leakage, but which otherwise assures that the engine and the generator can be cooled efficiently.

In order to attain the above object, the present invention provides an engine-operated generator unit comprising an engine and a generator driven by the engine arranged in a direction of a rotary shaft linking the engine and the generator in a soundproof case enclosing the engine, the generator and other components of the unit the generator including an outer-rotor; a centrifugal fan provided on an end surface of said outer-rotor of the generator remote from the engine; a duct covering the centrifugal fan, the generator and the engine, the duct having a suction opening at a side thereof facing the centrifugal fan and a discharge opening on a downstream side thereof facing an exterior of the soundproof case; and a circulation space being provided between the generator and the engine for introducing a part of cooling air flowing toward the engine into the generator to circulate again to the centrifugal fan.

Air within the soundproof case is inhaled or forced by the centrifugal fan into the duct through the suction opening of the duct and flows toward the engine, and a part of the air flowing toward the engine is introduced into the generator through the circulation space between the generator and the engine to be circulated again to the centrifugal fan. Thus, both the engine and the generator can be cooled by one centrifugal fan ventilating the duct.

Within the sole duct, the generator of relatively low temperature is positioned at an upstream side and the engine is positioned at a downstream side, so that the cooling is carried out efficiently in order from a lower temperature side toward a higher temperature side.

Since only one centrifugal fan for cooling is covered doubly by the duct and the soundproof case, leakage of noise to the exterior can be well restrained.

Since the outer-rotor of the generator serves as a flywheel of the engine, length of the engine-operated generator unit in the axial direction can be made short. Since the cooling fan is attached to the outer-rotor integrally, a cooling fan of large capacity can be provided easily and a high supporting strength for the fan can be obtained.

The centrifugal fan may be a two faces fan having a primary fan for inhaling or forcing air in the soundproof case through the suction opening of the duct and a secondary fan for circulating the air introduced into the generator through the recirculation space back to the centrifugal fan, the two fans being formed integrally together with a base plate.

The primary fan inhales or forces air in the soundproof case through the suction opening of the duct to form a primary air stream flowing toward the engine and the secondary fan functions to introduce a part of the primary air stream into the generator through the circulation space between the generator and the engine to circulate the introduced air to the centrifugal fan so that generator can be efficiently cooled.

The centrifugal fan may have a hole for circulating the air introduced into the generator through the circulation space back to the centrifugal fan.

The part of the primary air stream introduced into the generator through the circulation space between the generator and the engine circulates again to the centrifugal fan through he hole so that the generator can be properly cooled by a flowing air steam.

The generator may be an outer-rotor type multipolar generator having a magnet rotor serving as a flywheel of the engine, and a control circuit for converting an output of the generator into an alternating current of a predetermined frequency may also be provided with the unit.

Since the output of the multipolar generator is converted to an alternating current of a predetermined frequency, there is no need to maintain the rotational speed thereof constant as in case of a synchronous generator which has been used in this kind of engine-operated generator. Therefore, the rotational speed can be reduced when the load is not high to reduce operation noise at a rated operation or a low load operation.

The engine may be provided with a cylinder inclined sideways obliquely and a muffler may be disposed in a space above the cylinder within the duct.

Since a large muffler can be disposed in the space which is formed above the engine by inclining the cylinder, the size of the unit in the axial direction can be made small. Further, a reasonable cooling air stream can be generated for efficient cooling, because the hotter portion or muffler is positioned at the higher position.

The muffler may be elongated in a direction perpendicular to a rotary shaft of the engine. Therefore, the muffler of large capacity can be disposed in the space above the inclined cylinder with the vertical size of the apparatus restrained.

DETAILED DESCRIPTION OF THE PREFERRED EMBODIMENTS

Hereinafter, a preferred embodiment of the present invention will be described with reference to FIGS. 1 to 11.

Figure 1:
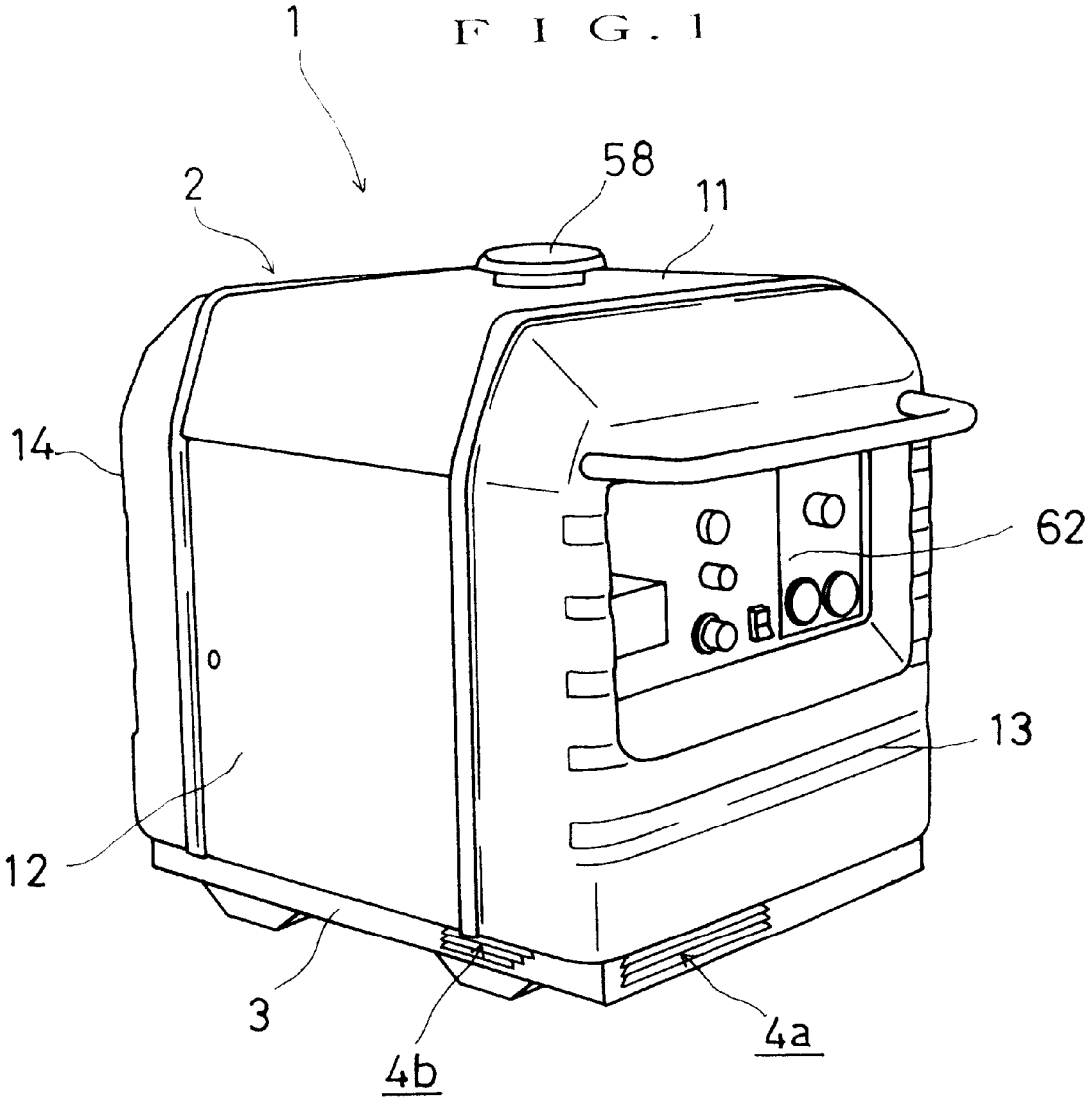
FIG. 1 is an outside perspective view of an engine-operated generator unit according to a preferred embodiment of the present invention.

The engine-operated generator unit 1 according to the preferred embodiment is covered with a soundproof case 2 in its entirety to form a cube as shown in FIG. 1.

Figure 2:
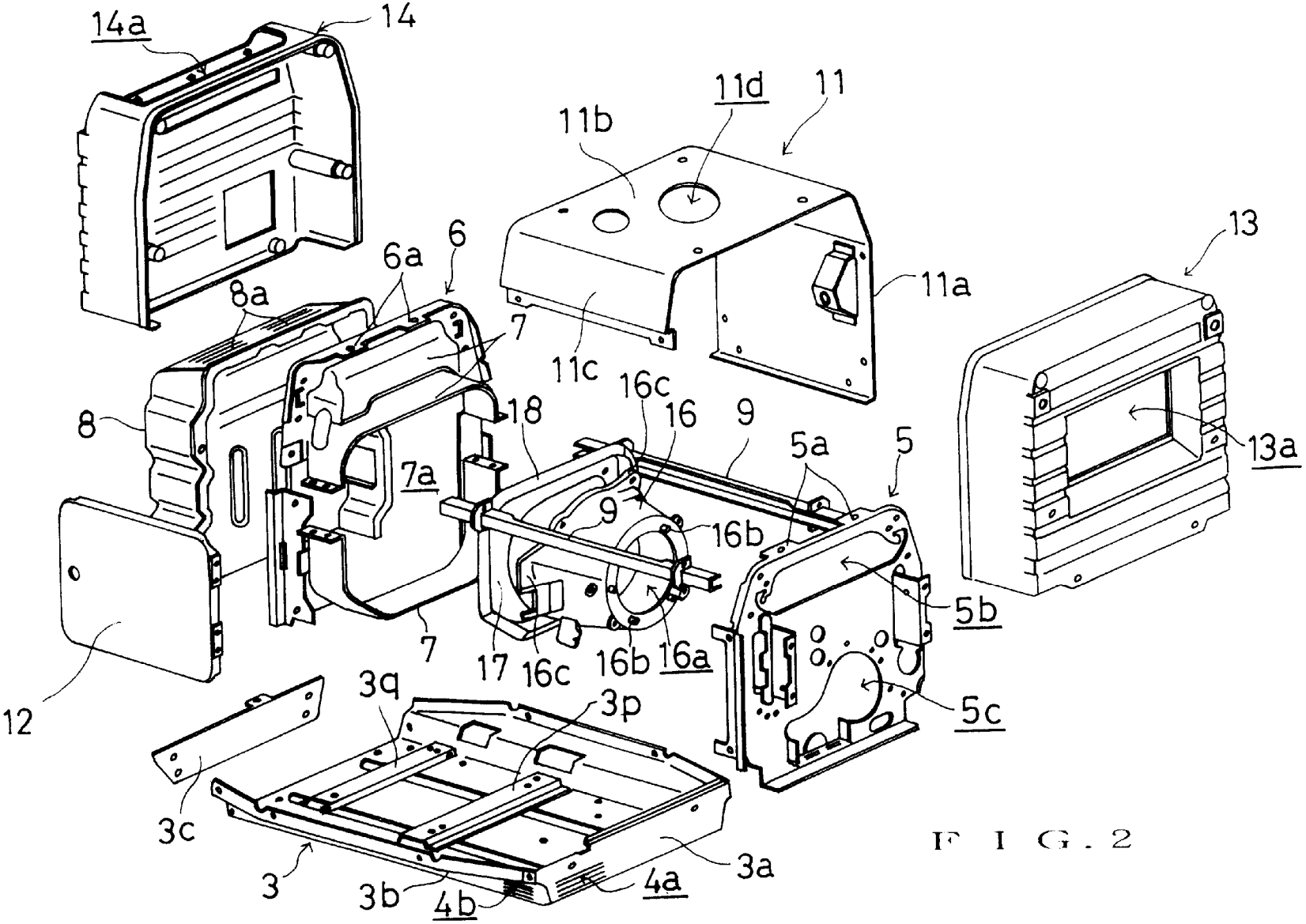
FIG. 2 is an exploded perspective view of a soundproof case and inner frame members thereof.

FIG. 2 is an exploded perspective view of the soundproof case 2 and other inner frame members. An under frame member 3 is formed in a shape of a flat saucer and has a front side wall 3*a*, a right side wall 3*b* and a rear side wall 3*c*. The front and right side walls 3*a*, 3*b* are provided with suction holes 4*a*, 4*b*. The rear side wall 3*c* is detachable. On the inner side of the under frame member 3 are laid a pair of front and rear supporting members 3*p*, 3*q* extending in the right-left direction in parallel with each other.

On the under frame member 3 are erected substantially rectangular front and rear frame members 5, 6 facing to each other at a predetermined interval.

Upper edge portions of the front frame member 5 are bent rearward to form flanges 5*a*. A rectangular panel portion of the front frame member 5 has a rectangular open hole 5*b*, elongated in the right-left direction at an upper part thereof and a communication hole 5*c* formed in a shape of a partly swelled circle at a lower part thereof.

On the one hand, the rear frame member 6 is split into upper and lower parts and a large rectangular central through hole 7*a* is formed when the upper and lower parts are joined. From the through hole 7*a* is projected forward a duct 7 formed integrally with the rear frame member 6. Upper edge portions of the rear frame member 6 are bent forward to form flanges 6*a*. The front portion of the duct 7 is shaped as a rectangular pipe opening to the front.

A duct 8 made of glass wool is disposed behind the rear frame member 6. The duct 8 swells out rearward communicating with the duct 7 through the through hole 7*a*. The duct 8 is also shaped as a substantially rectangular box opening toward the front and bottom and having a discharge opening 8*a* at an upper side wall thereof.

Between the front frame member 5 and the rear frame member 6 erected on the under frame member 3, a pair of right and left reinforcing rails 9, 9 are provided extending in front-rear direction and penetrating upper corners of the frame members 5, 6.

A center cover 11 shaped as a halved square pipe is placed along outer peripheral edges of the front and rear frame members 5, 6 for covering the space between the frame members 5, 6 to partition the space from the exterior.

The center cover 11 is formed in a shape of a half of a square pipe by bending a plate and has a left side wall 11*a*, an upper wall 11*b* and a right upper side wall 11*c*. The right under side of the center cover 11 is covered by an opening and closing separate lid member 12 to partition a center compartment 22 (FIG. 3) therein. In the upper wall of the center cover 11 is formed a circular hole lid through which a refueling mouth 55*b* of a fuel tank 55 projects (FIG. 4).

A front of the front frame member 5 is covered by a front cover 13 generally shaped as a rectangular box to partition a front compartment 21. A rear of the rear frame member 6 is covered by a rear cover 14 also generally shaped as a rectangular box to partition a rear compartment 23. Along the inner surface of the rear cover 14 extends the aforementioned glass wool duct 8 as a liner. Therefore, the rear compartment 23 is formed inside of the duct 8.

A central portion of a front wall of the front cover 13 is recessed and there is formed a rectangular opening 13*a* for a control panel 62. In an upper wall of the rear cover 14 is formed a rectangular opening 14*a* corresponding to the discharge opening 8*a* provided on the aforementioned duct 8.

As mentioned above, the soundproof case 2 constituting an outer wall of the engine-operated generator 1 has six faces formed by the under frame member 3, the center cover 11, the lid member 12, the front cover 13 and the rear cover 14. And the inner space of the soundproof case 2 is partitioned into the front compartment 21, the center compartment 22 and the rear compartment 23 by the front frame member 5 and the rear frame member 6.

In addition, within the center compartment is provided a fan cover 16, which serves as a duct too, continuously to the rectangular-pipe-like section of the duct 7 swelling out into the center compartment 22 from the rear frame member 6. The fan cover 16 is substantially cylindrical in shape to cover a generator 35 and a centrifugal fan 40 and has a suction opening 16*a* which is a circular opening at the front end thereof. On a circular end surface at the suction opening 16*a* are provided a plurality of projections 16*b* having predetermined lengths.

The fan cover 16 has a flange 16*c* projecting radially outward at an open rear end thereof and a rectangular frame member 17 is attached to the flange 16*c* from the rear. The rectangular frame member 17 is surrounded by a seal rubber 18 along the rectangular outer peripheral edge thereof and fitted in the rectangular-pipe-like section of the duct 7 being sealed by the seal rubber 18.

Namely, the fan cover 16 is connected with the duct 7 of the rear frame member 6 through the rectangular frame member 17 and the duct 7 is connected with the duct 8 which swells out rearward from the rear frame member 6 to form the rear compartment 23.

Therefore, within the soundproof case 2, a duct space which is formed by the fan cover 16,. the duct 7 and the duct 8 occupies the rear compartment 23 and a part of the center compartment 22. The duct space has on an upper stream side the suction opening 16*a* opening into the center compartment 22 and a lower stream side on the discharge opening 8*a* provided in the upper side wall of the duct 8. The discharge opening 8*a* faces the rectangular opening 14*a* of the rear cover 14 and opens to the exterior of the soundproof case 2.

On the above-mentioned frame construction and duct construction within the soundproof case 2 are disposed various instruments. The engine 30 is accommodated in the ducts 7, 8 at the rear of the soundproof case 2 as shown in FIG. 4, and supported by a pair of right and left vibration proof mount members 31 fixed to the supporting member 3*q* on the under frame member 3 (FIGS. 4 and 6).

Figure 6:
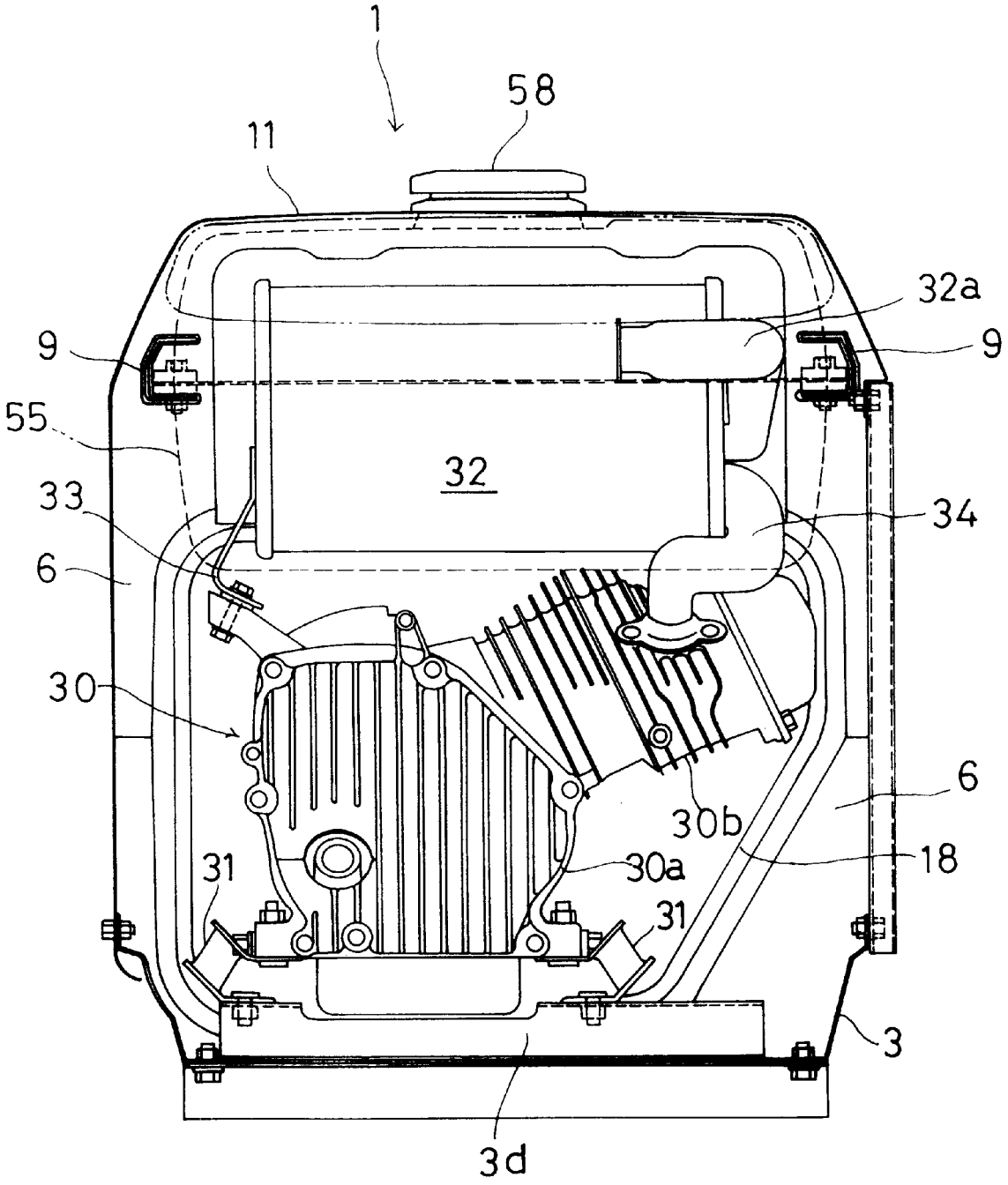
FIG. 6 is a rear view thereof.
Figure 7:
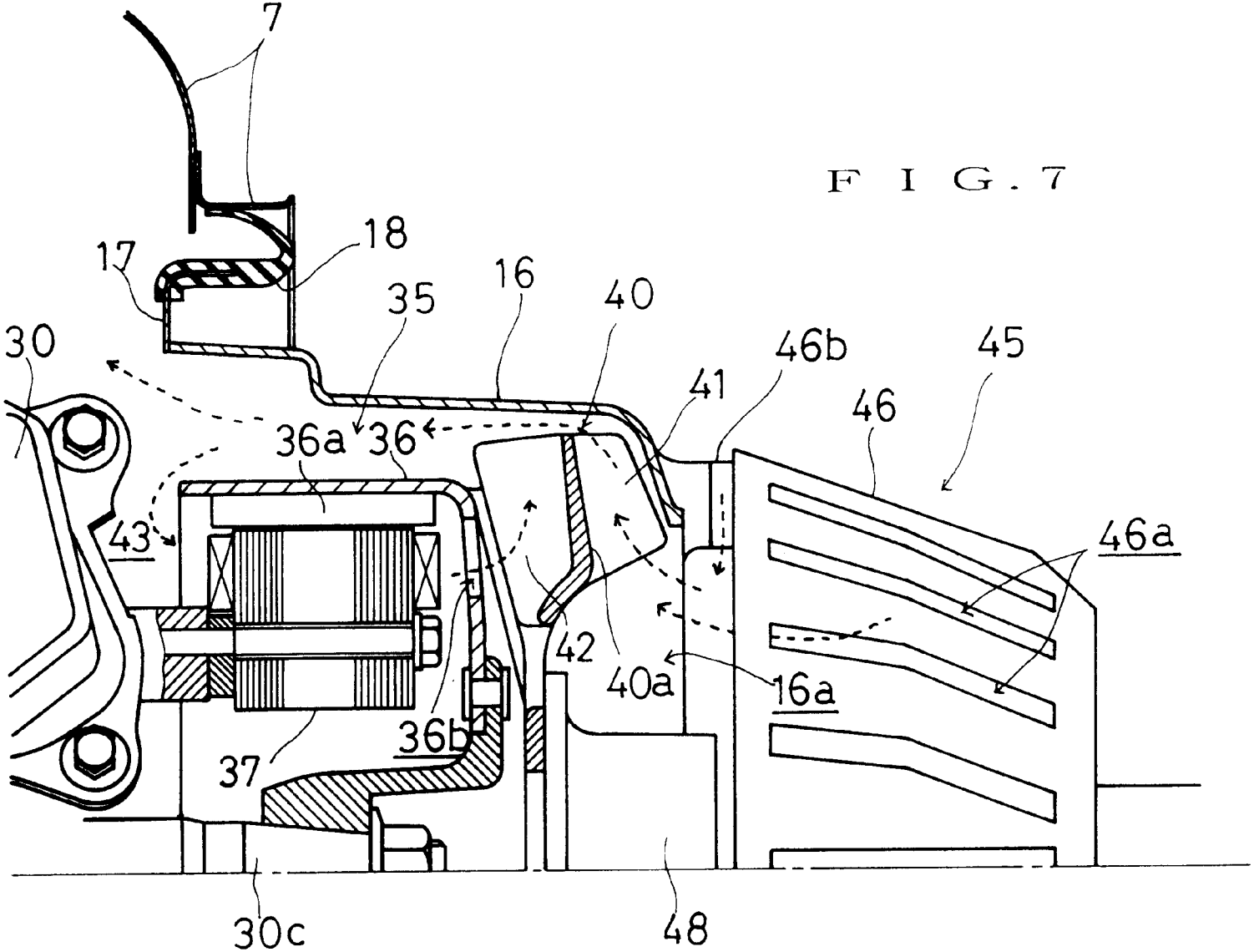
FIG. 7 is an enlarged side view showing partly by section the generator and vicinity thereof.
Figure 8:
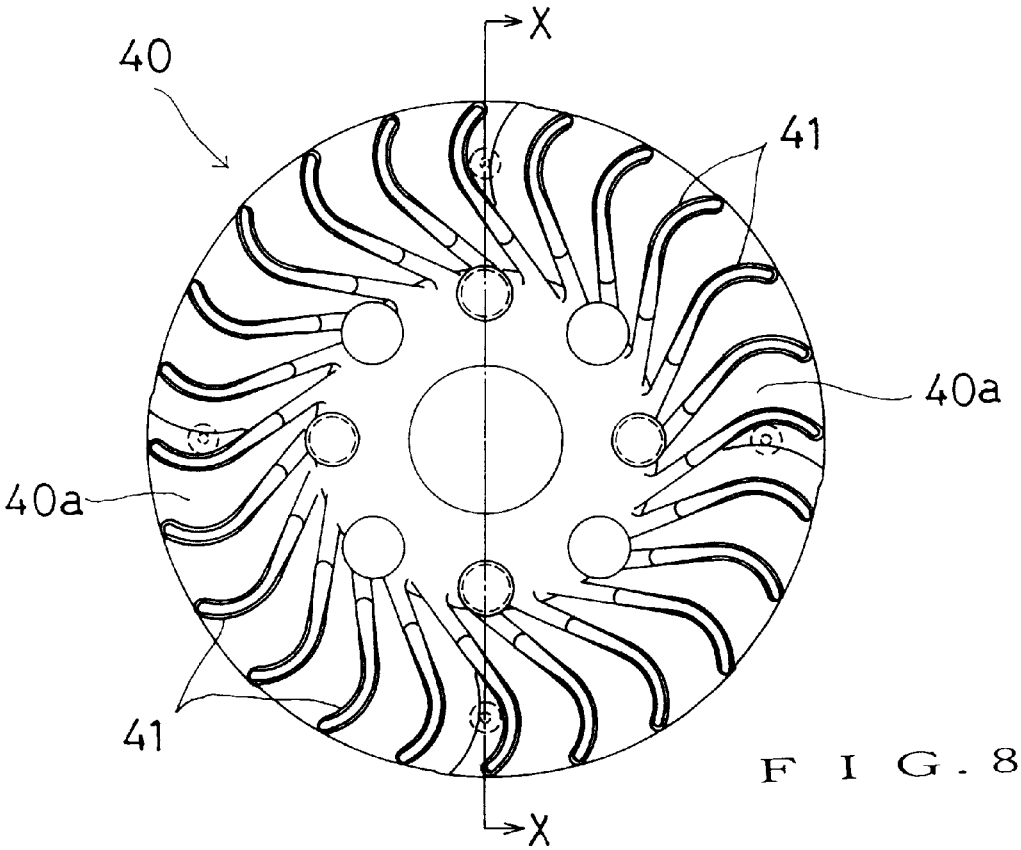
FIG. 8 is a front view of a centrifugal fan.
Figure 9:
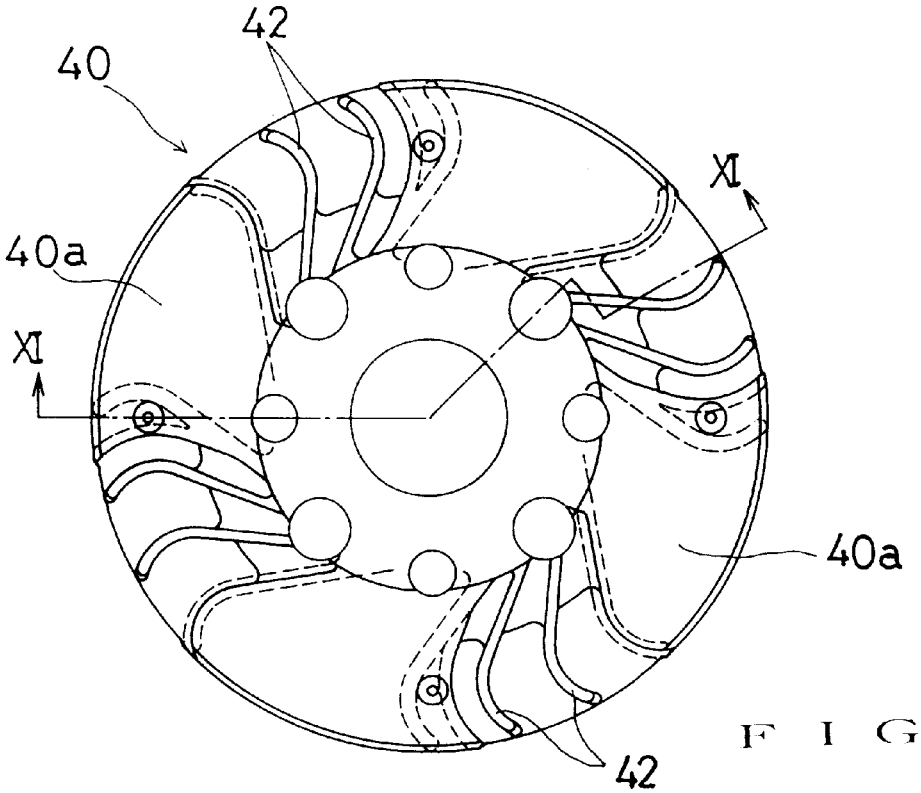
FIG. 9 is a rear view thereof.
Figure 10:
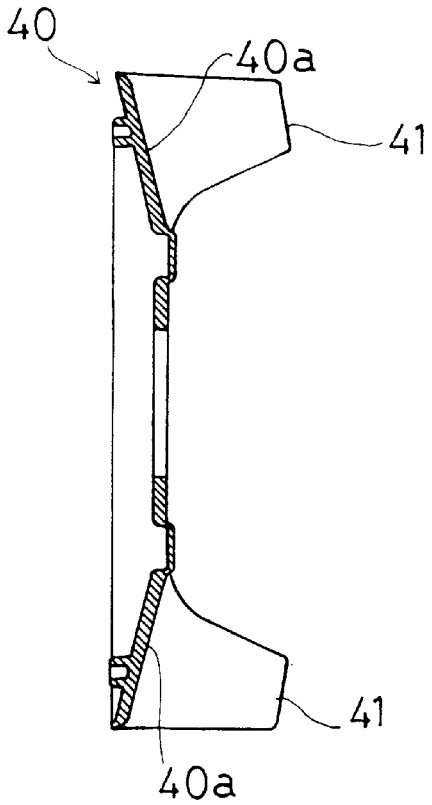
FIG. 10 is a section taken along the line X—X of FIG. 8.

As shown in FIGS. 2, 6 and 7 the engine 30 has a crankcase 30*a* positioned biased to the left side, a cylinder 30*b* projecting inclined to the right direction somewhat upwardly and a crankshaft 30*c* extending in the front-rear direction horizontally and projecting forward.

Since the cylinder 30*b* of the engine 30 is inclined as mentioned above, a large upper space can be ensured in the ducts 7, 8, and in this space, a large cylindrical muffler 32 is disposed extending in right-left direction. The muffler 32 is supported by the engine by means of a bracket 33 and an exhaust pipe 34 extending upward from the cylinder 30*b* is connected with the muffler 32. A tail pipe 32*a* extends around the muffler 32 from a right side wall to a rear face thereof, and an exhaust opening of the tail pipe is positioned in the vicinity of the discharge opening 8*a*.

The generator 35 is connected to the crankshaft 30*c* projecting forward from the crankcase 30*a*. The generator 35 is an outer-rotor type multipolar generator having an outer-rotor 36 shaped as a bottomed cylinder fixed to the crankshaft 30*c* integrally. A plurality of magnets 36*a* are stuck circumferentially on an inner surface of a peripheral wall of the rotor 36 so as to rotate together with the crankshaft 30*c*. The outer-rotor 36 serves as a flywheel of the engine, too.

The outer-rotor 36 has a bottom wall at the front and opens rearward. As for the inner stator 37 of the generator 35, a stator core having a plurality of radial yokes and generating coils wound on the yokes is fixed to the crankcase 30*a*.

The bottom wall of the outer-rotor 36 is formed with a plurality of ventilating holes 36*b* and the centrifugal fan 40 is fixed to the bottom wall of the outer-rotor 36 from the front.

Referring to FIGS. 8 to 11, the centrifugal fan 40 is a two faces fan having a primary fan 41 on a front face of a disk-like base plate 40*a* and a secondary fan 42 on a rear face thereof.

Figure 11:
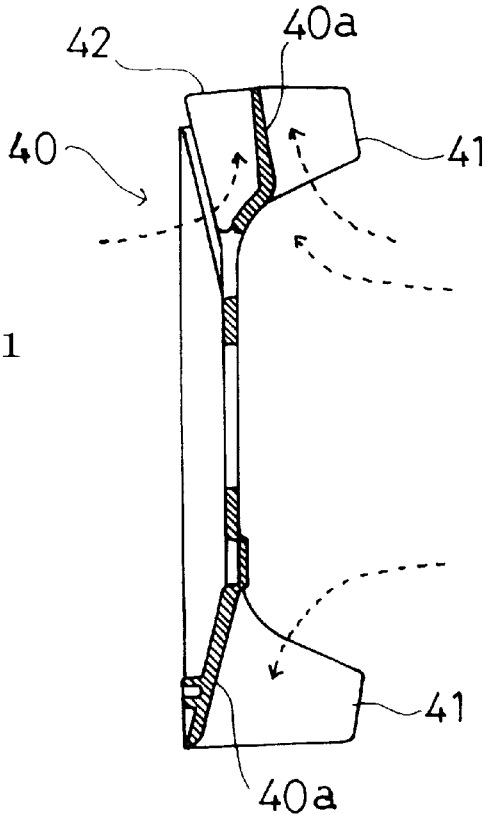
FIG. 11 is a section taken along the line XI—XI of FIG. 9.

When the centrifugal fan 40 operates, the primary fan 41 inhales or forces air into the center portion from the front to form an air stream discharged radially outward along the front face of the disk-like base plate 40*a*, and the secondary fan 42 rotating together with the primary fan 41 inhales or forces air in the rear into the center portion to form an air stream discharged radially outward along the rear face of the base plate 40*a* (ref. arrows of dotted line in FIG. 11).

The fan cover 16 covers the generator 35 and the centrifugal fan 40 with the suction opening 16*a* at the front end thereof opposed to the centrifugal fan 40. The rear end of the fan cover 16 is fixed to the crankcase 30*a* of the engine 30 together with the rectangular frame member 17.

In front of the fan cover 16, a recoil starter 45 is provided opposite to the suction opening 16*a*. A predetermined space is left between the recoil starter 45 and the fan cover 16 by the projections 16*b* on the end surface surrounding the suction opening 16*a* of the fan cover 16. A boss section 46*b* of a starter case 46 of the recoil starter 45 is fixed to the fan cover 16 to be supported integrally therewith.

Figure 3:
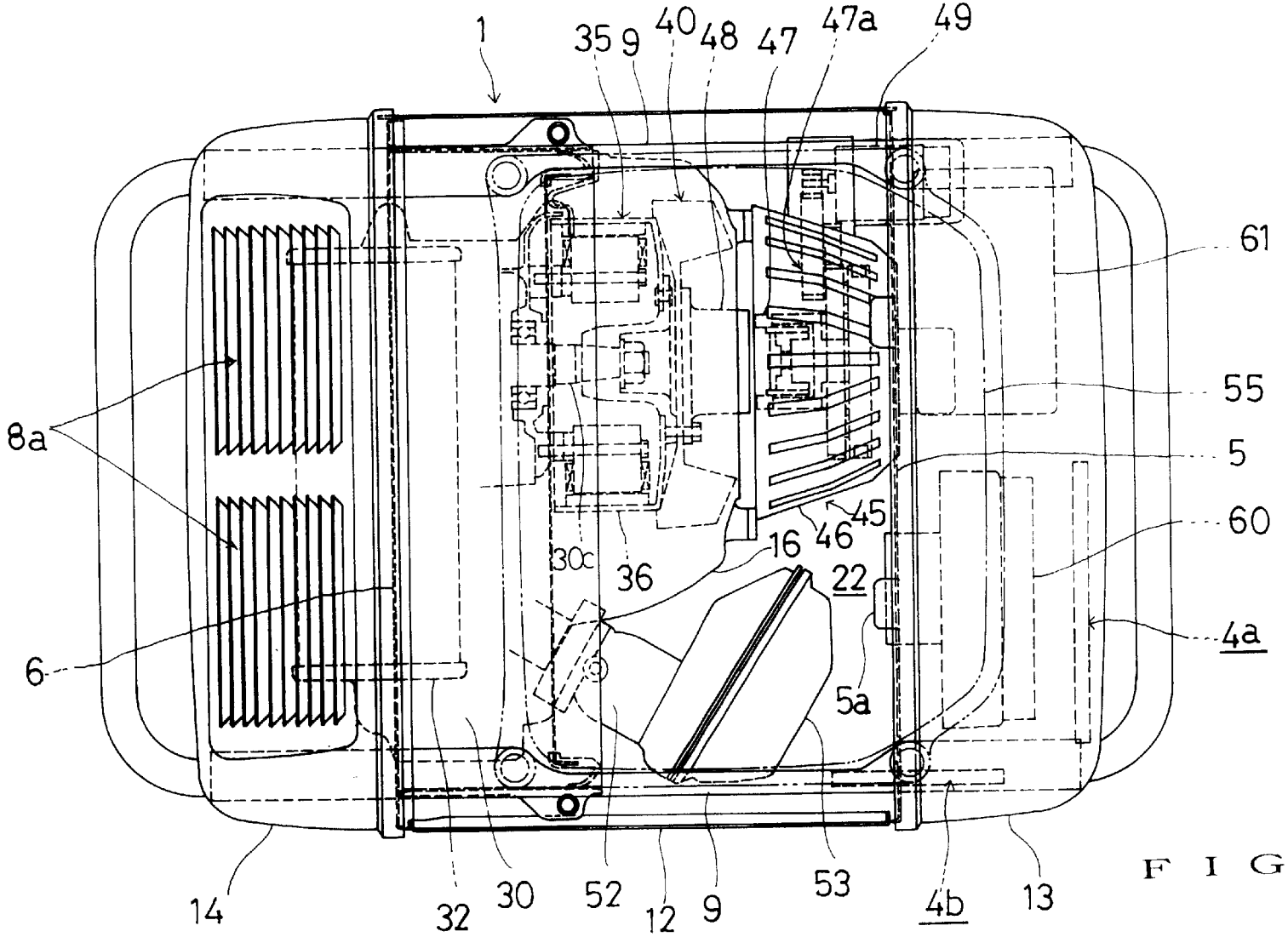
FIG. 3 is a plan view showing the engine-operated generator in which a center cover and a fuel tank are omitted to show inner details of the unit.
Figure 4:
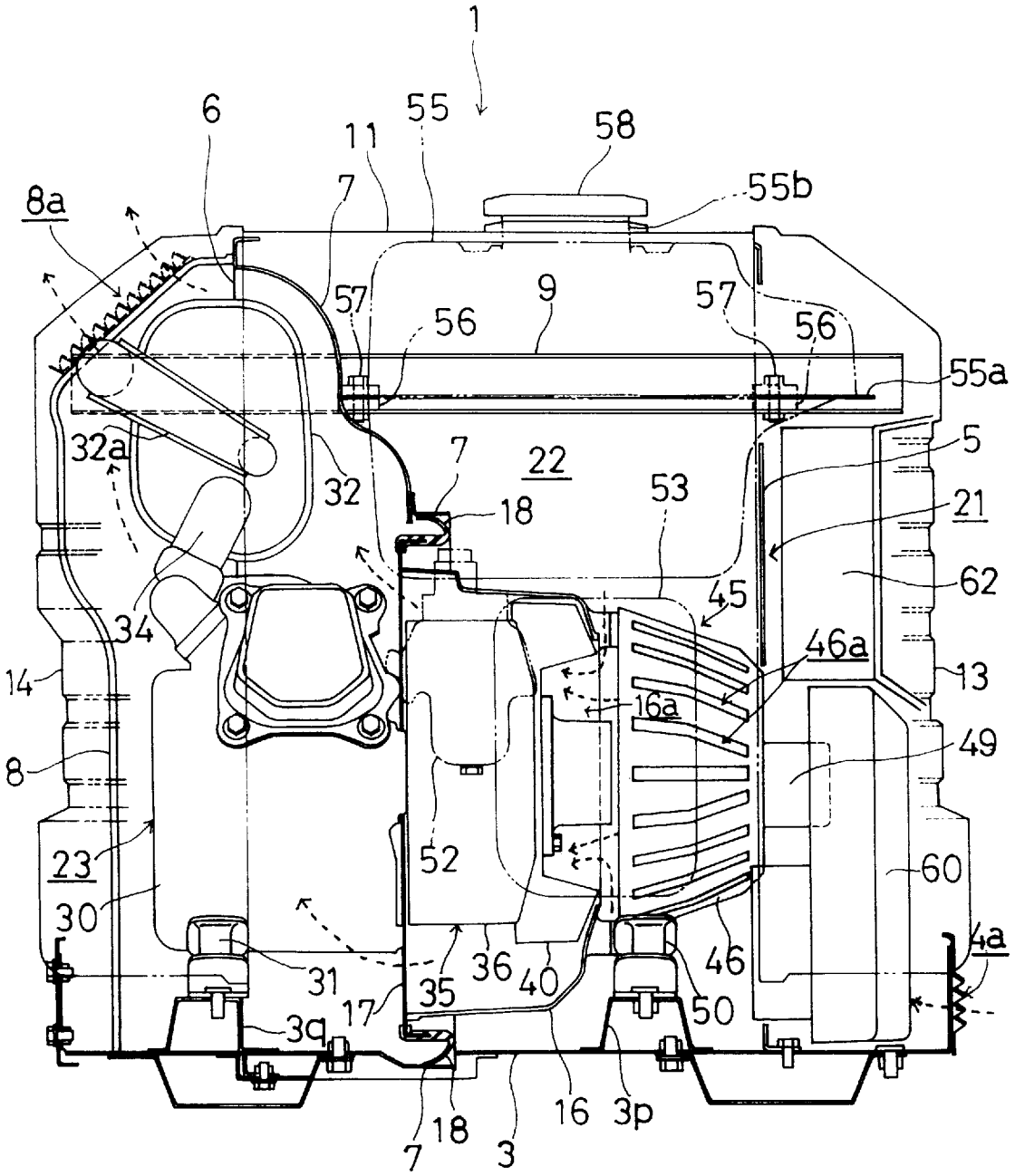
FIG. 4 is a side view of the engine-operated generator partly omitted for, again, showing inner details of the unit.

Referring to FIG. 3, the recoil starter 45 has a ratchet wheel 47 provided on a rotary shaft which is coaxial with the crankshaft 30*c* so as to be projected rearward relative thereto. A ratchet 48 opposing to the ratchet wheel 47 is attached to a central part of the centrifugal fan 40.

The ratchet wheel 47 is driven through a gear train 47*a* by a starter lever and is also driven by a starter motor 49 provided at a left end of the starter case 46.

When the ratchet wheel 47, which is usually separated from the ratchet, is driven by the starter motor 49 for example, the ratchet wheel 47 projects rearward to engage with the ratchet 48 and the crankshaft 30*c* is rotated forcibly through the ratchet 48 and the outer-rotor 36 to start the engine 30.

The starter case 46 of the recoil starter 45 has a conical wall in which a plurality of slits 46*a* are formed arranged circumferentially. Cooling air is introduced into the suction opening 16*a* of the fan cover 16 through the space between the end face of the fan cover 16 and the starter case 46 and further through the slits 46*a*.

Figure 5:
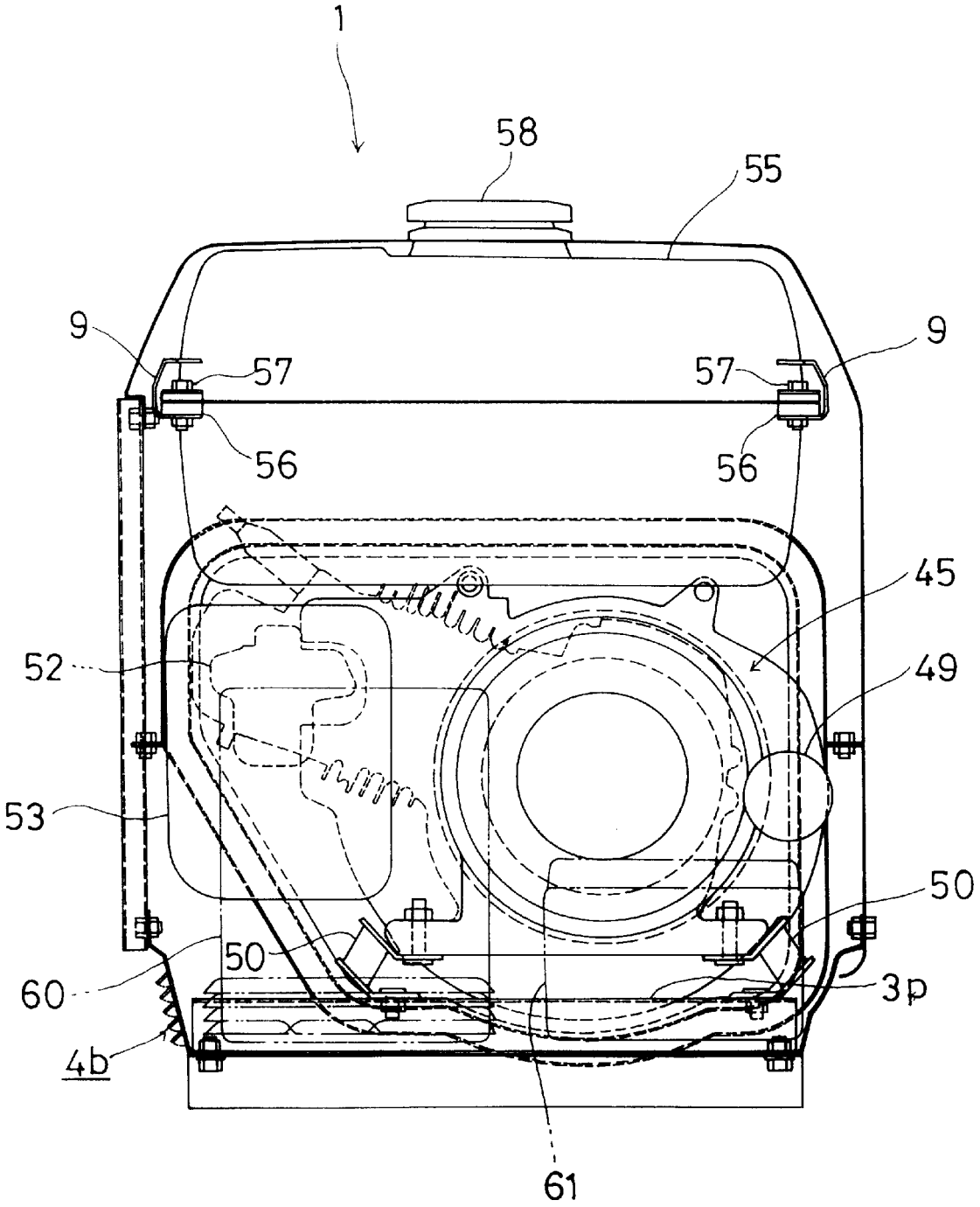
FIG. 5 is a front view thereof.

The recoil starter 45 is positioned in the center compartment 22 and supported by a pair of right and left vibration proof mount members 50 fixed to the supporting member 3*p* on the under frame member 3 (FIGS. 4, 5).

The engine 30 and the recoil starter 45 are connected integrally by the fan cover 16 to constitute a vibratory unit. The engine 30 in the rear is supported by the vibration proof mount members 31 and the recoil starter 45 in the front is supported by the vibration proof mount members 50, so that the vibratory unit can be supported efficiently at positions near both the front and rear end portions thereof.

Since the generator 35 and the recoil starter 45 are disposed in front of the crankcase 30*a* positioned left extending over the rear compartment 23 and the center compartment 22, there is formed a space on the right side of the fan cover 16 and the recoil starter 45 in the center compartment 22, and in this space are arranged a carburetor 52 and an air-cleaner 53 with the air-cleaner 53 positioned in front.

While the muffler 32 is disposed above the engine 30, the fuel tank 55 is disposed in a space above the fan cover 16, the recoil starter 45, the carburetor 52 and the air-cleaner 53 in the center compartment 22.

The fuel tank 55 is supported on the right and left reinforcing rails 9 laid between the front frame member 5 and the rear frame member 6 by means of a flange 55*a* fixed to the rails 9 by bolts 57 with vibration proof rubbers 56 inserted.

A part of the fuel tank 55 is extruded into the front compartment 21 through the upper open hole 5*b* of the front frame member 5. The refueling mouth 55*b* of the fuel tank 55 is projected upward through the circular hole lid of the center cover 11 and a fuel cap 58 is screwed on an upper end of the refueling mouth 55*b*.

The fuel tank 55 is disposed in a space outside of the fan cover 16 and the duct 7 within the center compartment together with suction system instruments such as the carburetor 52 and the air-cleaner 53, and fuel system parts of the engine 30 are concentrated in the lump. Thus, the space is utilized efficiently and the apparatus is made compact.

In the flat rectangular space of the front compartment 21 covered by the front cover 13 in front of the front frame member 5, an inverter device 60 and a battery 61 are disposed right and left on the under frame member 3 and above them is provided the control panel 62 facing the front rectangular opening 13*a* of the front cover 13. Namely, electric instruments are concentrated in the front compartment 21.

The inverter device 60 converts output of the multipolar generator 35 into alternating current of a predetermined frequency. The inverter device 60 is disposed on the right side of the front compartment 21 near the suction holes 4*a*, 4*b* to be cooled by sucked outer air as it is initially drawn into the soundproof case.

As described above, the engine-operated generator 1 having the soundproof case 2 is constructed in such a manner that the generator 35, the engine 30 and the muffler 32 are arranged in this order and accommodated in the ducts 7, 8 and the fan cover 16.

The suction opening 16*a* of the fan cover 16 opens into the center compartment 22 and the centrifugal fan 40 is provided inside of the suction opening 16*a*, so that by rotation of the centrifugal fan 40, air is introduced into the center compartment 22 through the front compartment 21 from exterior of the soundproof case 2 and inhaled in the fan cover 16 through the slits 46*b* in the starter case 46 of the recoil starter 45, the space between the fan cover 16 and the starter case 46, and the suction opening 16*a* (streams of the air are shown by arrows of dotted line in FIGS. 4 and 7).

As shown in FIG. 7, air inhaled in the fan cover 16 through the suction opening 16*a* by the primary fan 41 on the front face of the centrifugal fan 40 is discharged radially outward and flows along the inner peripheral surface of the fan cover 16 and the outside of the outer-rotor 36 of the generator 35 toward the engine 30 to cool the engine.

In a middle of a passage of the above-mentioned primary air stream, a space 43 is formed between the generator 35 and the engine 30, and a part of the primary air stream branches and is directed to the inside of the outer-rotor 36 through the space 43 as circulating air. This circulating air is generated by the secondary fan 42 provided on the rear face of the centrifugal fan 40 and the space 43.

The air directed in the inside of the outer-rotor 36 cools the generating coil, reaches the secondary fan 42 through the ventilating holes 36*b* in the bottom wall of the outer-rotor 36, and is again discharged radially outward to rejoin the primary air stream.

The air introduced in the engine 30 including the above-mentioned recirculated air cools the engine and then flows upward guided by the ducts 7, 8 to cool the muffler 32 (FIG. 4). After cooling the muffler 32, the air is discharged to the exterior through the discharge opening 8*a* of the soundproof case 2 positioned above the muffler facing the exterior.

Since the center compartment 22 communicates with the front compartment 21 through the communication hole 5*c* of the front frame member 5, air introduced from the exterior through the suction holes 4*a*, 4*b* into the front compartment 21 is inhaled into the center compartment 22. At that time, the front compartment 21 acts as a labyrinth duct for introducing exterior air which restrains leakage of suction noise occurring in the center compartment 22. The inverter device 60 is positioned in the course of the suction air stream from the suction holes 4*a*, 4*b* to be cooled effectively.

The generator 35, the engine 30 and the muffler 32 which are heat sources are covered by the fan cover 16 and the ducts 7, 8 so as to be isolated from other instruments, and the air inhaled in the fan cover 16 by the centrifugal fan 40 through the suction 22 initially cools the generator 35 of relatively low temperature and then the engine 30 and the muffler 32 of higher temperature and is finally discharged to the exterior through the discharge opening 8a. Therefore, an efficient cooling can be carried out.

Since a part of the primary air stream flowing in the fan cover 16 and the duct 7 by action of the centrifugal fan 40 toward the engine is introduced into the generator 35 through the circulation space 43 between the generator 35 and the engine 30 and recirculates to the centrifugal fan again, both the engine 30 and the generator 35 can be cooled by one centrifugal fan 40 ventilating the duct 7, 8. Moreover, within the sole duct 7, 8, the generator 35 of relatively low temperature is positioned at an upper stream side and the engine 30 is positioned at a lower stream side so that the cooling is carried out efficiently in sequential order from a lower temperature side toward a higher temperature side.

Since the sole centrifugal fan 40 for cooling is covered doubly by the fan cover 16 and the soundproof case 2, leakage of noise to the exterior can be well-restrained.

Since the centrifugal fan 40 is attached to the outer-rotor 36 of the generator 35, the centrifugal fan of a large capacity can be furnished easily and a high fan supporting strength can be obtained.

Since the muffler 32 is disposed above the engine 30 in such a manner that the hotter instrument is positioned at the higher position and the discharge opening 8*a* is provided above the muffler 32, a reasonable cooling air stream can be generated for efficient cooling.

In addition, since the cylinder 30*b* of the engine 30 is inclined sideways and the muffler 32 is disposed above same, the vertical size of the engine-operated generator can be restrained small while still utilizing the muffler 32 of a large capacity.

Since the output of the multipolar generator 35 is converted into an alternating current of a predetermined frequency, there is no need to maintain the rotational speed thereof constant regardless of the load in order to maintain the output frequency constant as in case of a synchronous generator which has began used in this kind of engine-operated generator. Therefore, the rotational speed can be reduced when the load is not large to reduce operation noise greatly.

Figure 12:
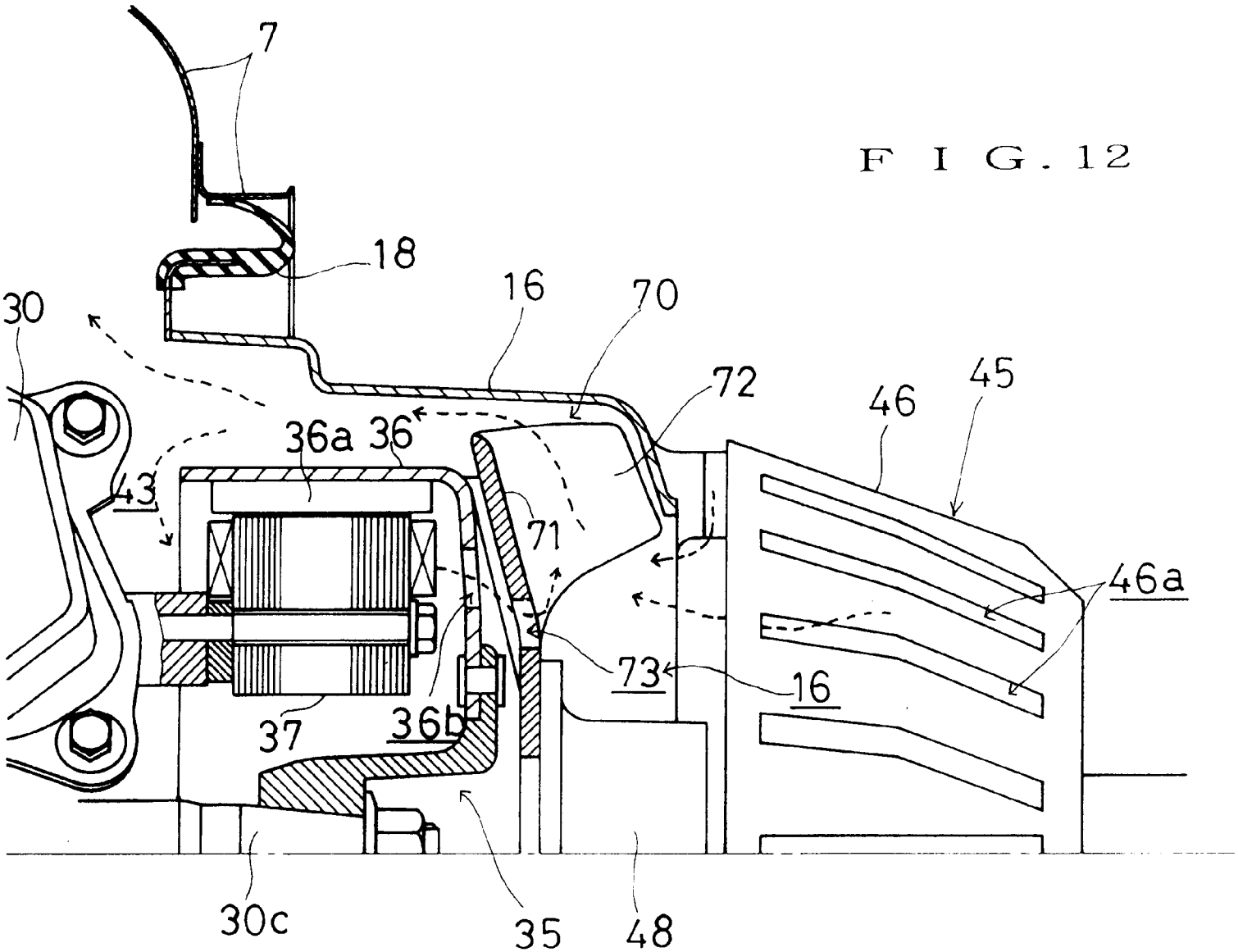
FIG. 12 is a side view similar to FIG. 7 showing partly by section a generator in an engine-operated generator according to another embodiment using another centrifugal fan and vicinity thereof.

FIG. 12 shows another embodiment of the present invention having a centrifugal fan different from the above-described centrifugal fan 40. In FIGS. 12 and 7, the same members are shown by the same symbols excepting the centrifugal fans 70, 40.

The centrifugal fan 70 is a single face fan and has fan blades 72 formed on a front face of a disk-like base plate 71 and holes 73 for circulation formed at a predetermined positions of the base plate 71. The holes 73 are provided corresponding to the ventilating holes 36*b* formed in the bottom wall of the outer-rotor 36*a* of the generator 35.

Air is inhaled in the fan cover 16 through the suction hole 16*a* and discharged radially outward by action of the centrifugal fan 70. Then, the air flows along the inner peripheral surface of the fan cover 16 and the outside of the outer-rotor 36 of the generator 35 to cool the engine 30. Again, however, a part of the air flow is introduced in the space 43 between the generator 35 and the engine 30 to be directed to the inside of the outer-rotor 36.

The air directed to the inside of the outer-rotor 36 cools the generating coil and reaches to the front of the disk-like base plate 71 through the ventilating holes 36*b* of the bottom wall of the outer-rotor 36 and the holes 73 in the fan base plate 71 to join the suction air from the suction hole 16*a*.

The air stream inhaled through the suction hole 16*a* and flowing radially outward along the front face of the disk-like base plate 71 produces a negative pressure in rearward of the holes 73 to introduce the circulating air into the space 43.

Thus, the air after cooling the generator 35 returns to the suction air and flows again toward the engine 30 to cool it, so that both the generator 35 and the engine 30 can be cooled efficiently very similar to the first embodiment.

Although there have been described what are at present considered to be the preferred embodiments of the invention, it will be understood by persons skilled in the art that modifications and variations may be made thereto without departing from the spirit, gist or essence of the invention. The scope of the invention is indicated by the appended claims.

What is claimed is:

1. An engine-operated generator unit comprising:

an engine having a rotary shaft;

a generator drivable by the engine and arranged in a direction of the rotary shaft; a soundproof case housing the engine, the generator and other components of the unit therein;

said generator including an outer-rotor;

a centrifugal fan provided on an end surface of the outer-rotor remote from said engine;

a duct covering said centrifugal fan, said generator and said engine and having a suction opening at a side facing said centrifugal fan;

a discharge opening on a downstream side of said duct facing an exterior of said soundproof case; and a circulation space provided between said generator and said engine for introducing a part of cooling air flowing toward said engine into said generator to circulate again to said centrifugal fan.

2. An engine-operated generator as claimed in claim 1, wherein said centrifugal fan is a two faces fan having a primary fan for inhaling air in said soundproof case through the suction opening of said duct and a secondary fan for circulating said air introduced into said generator through said circulation space back to said centrifugal fan, and said primary and secondary fans are formed integrally.

3. An engine-operated generator as claimed in claim 1, wherein said centrifugal fan has a hole formed therein for circulating said air introduced into said generator through said circulation space back to said centrifugal fan.

4. An engine-operated generator as claimed in claim 1, wherein said generator is an outer-rotor type multipolar generator having a magnet rotor serving as a flywheel of said engine, and said unit further comprises a control circuit for converting an output of said generator into an alternating current of a predetermined frequency.

5. An engine-operated generator as claimed in claim 1, wherein said engine includes a cylinder inclined sideways obliquely and said unit further includes a muffler disposed in a space above said engine within said duct.

6. An engine-operated generator as claimed in claim 5, wherein said muffler is elongated in a direction perpendicular to the rotary shaft of said engine.

7. An engine-operated generator as claimed in claim 2, wherein said generator is an outer-rotor type multipolar generator having a magnet rotor serving as a flywheel of said engine, and said unit further comprises a control circuit for converting an output of said generator into an alternating current of a predetermined frequency.

8. An engine-operated generator as claimed in claim 3, wherein said generator is an outer-rotor type multipolar generator having a magnet rotor serving as a flywheel of said engine, and said unit further comprises a control circuit for converting an output of said generator into an alternating current of a predetermined frequency.

9. An engine-operated generator as claimed in claim 2, wherein said engine includes a cylinder inclined sideways obliquely and said unit further includes a muffler disposed in a space above said engine within said duct.

10. An engine-operated generator as claimed in claim 3, wherein said engine includes a cylinder inclined sideways obliquely and said unit further includes a muffler disposed in a space above said engine within said duct.

11. An engine-operated generator as claimed in claim 9, wherein said muffler is elongated in a direction perpendicular to the rotary shaft of said engine.

12. An engine-operated generator as claimed in claim 10, wherein said muffler is elongated in a direction perpendicular to the rotary shaft of said engine.

13. An engine-operated generator unit comprising:

an engine having a rotary output shaft;

a generator drivably connected to the engine and arranged in a direction of the rotary output shaft;

a soundproof case housing the engine, the generator and other components of the unit therein;

the generator including an outer-rotor;

a centrifugal fan provided on an end surface of the outer-rotor;

duct means covering the centrifugal fan, the generator and the engine within the soundproof case, the duct means having a suction opening at a side facing the centrifugal fan and a discharge opening at a downstream side thereof facing an exterior of the soundproof case;

the centrifugal fan generating an air flow within said duct means directed toward said engine; and circulation means for circulating part of said air flow generated by said centrifugal fan away from said engine, into said generator and back to said centrifugal fan.

14. An engine-operated generator unit according to claim 13, wherein said circulating means includes a circulation space provided between said generator and said engine and a vent hole defined in a bottom wall of said outer-rotor.

15. An engine-operated generator unit according to claim 14, wherein said circulating means further includes a hole formed in a base plate of said centrifugal fan and communicating with said vent hole in the bottom wall of said outer-rotor.

16. An engine-operated generator unit according to claim 14, wherein said centrifugal fan is a two faces fan having a primary fan for generating said air flow and a secondary fan as part of said circulating means, and said primary and secondary fans are formed integrally.

* * * * *

UNITED STATES PATENT AND TRADEMARK OFFICE

CERTIFICATE OF CORRECTION

PATENT NO : 6,028,369

DATED : 22 February 2000

INVENTOR(S): Tadafumi Hirose, Ryuji Tsuru, Katsumi Maruyama

It is certified that error appears in the above-identified patent and that said Letters Patent is hereby corrected as shown below:

On the cover page, in the "[57] ABSTRACT", 9th line, change "surface the" to --surface of the--;
13th line, change "operating" to --opening--.

Column 1, line 8, change "Related" to --Relevant--;
line numbered between 28 and 29, before "properly" insert --cooling air is--;
line numbered between 29 and 30, delete "cooling air is";
line 59, change "erator in a" to --erator; a--;
line 60, after "unit" insert a comma.

Column 2, line 39, after "that" insert --the--;
line numbered between 47 and 48, change "he hole" to --the hole--;
line 56, change "to" to --into--.

Column 3, line 35, change "fan and" to --fan, and the--.

Column 4, line numbered between 26 and 27, change "lid" to --11*d*--.

Column 5, line 11, after "and" insert --on--; change "on the" to --the--;
line 20, change "vibration" to --vibration- --.

Column 6, line 22, change "ratchet," to --ratchet 48,--;
line numbered between 34 and 35, change "vibration" to --vibration- --;
line numbered between 39 and 40, change "vibration proof" to --vibrationproof--;
line numbered between 41 and 42, change "vibration proof" to --vibrationproof--;
line 60, change "vibration proof" to --vibrationproof--;
line 65, change "lid" to --11*d*--.

UNITED STATES PATENT AND TRADEMARK OFFICE

CERTIFICATE OF CORRECTION

PATENT NO : 6,028,369

DATED : 22 February 2000

INVENTOR(S): Tadafumi Hirose, Ryuji Tsuru, Katsumi Maruyama

It is certified that error appears in the above-identified patent and that said Letters Patent is hereby corrected as shown below:

Column 8, line 8, change "22" to --opening **16*a***--;
line numbered between 48 and 49, change "began" to --been--;
line 60, change "at a" to --at--.

Column 9, 12th line, change "in rearward" to --rearward--.

Signed and Sealed this

Ninth Day of January, 2001

*Attest:*

*Attesting Officer*

Q. TODD DICKINSON

*Commissioner of Patents and Trademarks*